US008511069B2

(12) United States Patent
Gonze et al.

(10) Patent No.: US 8,511,069 B2
(45) Date of Patent: Aug. 20, 2013

(54) SYSTEMS AND METHODS FOR LAYERED REGENERATION OF A PARTICULATE MATTER FILTER

(75) Inventors: Eugene V. Gonze, Pinckney, MI (US); Michael J. Paratore, Jr., Howell, MI (US); Garima Bhatia, Bangalore (IN)

(73) Assignee: GM Global Technology Operations LLC

( * ) Notice: Subject to any disclaimer, the term of this patent is extended or adjusted under 35 U.S.C. 154(b) by 384 days.

(21) Appl. No.: 12/539,838

(22) Filed: Aug. 12, 2009

(65) Prior Publication Data

US 2011/0036076 A1 Feb. 17, 2011

(51) Int. Cl.

| | |
|---|---|
| ***F01N 3/00*** | (2006.01) |
| ***F01N 3/02*** | (2006.01) |
| ***F02B 27/04*** | (2006.01) |

(52) U.S. Cl.

USPC ..... 60/295; 60/300; 60/303; 60/320; 60/273

(58) Field of Classification Search

USPC ..... 60/295, 297, 311, 274, 300, 302, 60/301; 219/497, 202, 206, 492

See application file for complete search history.

(56) References Cited

U.S. PATENT DOCUMENTS

| | | | | |
|---|---|---|---|---|
| 4,404,795 | A | 9/1983 | Oishi et al. | |
| 4,404,796 | A * | 9/1983 | Wade | 60/274 |
| 4,427,418 | A * | 1/1984 | Kogiso et al. | 55/287 |
| 4,516,993 | A * | 5/1985 | Takeuchi et al. | 55/283 |
| 4,549,395 | A | 10/1985 | Dammann | |
| 4,549,398 | A * | 10/1985 | Oishi et al. | 60/286 |
| 4,685,290 | A | 8/1987 | Kamiya et al. | |
| 5,144,798 | A | 9/1992 | Kojima et al. | |
| 5,171,335 | A | 12/1992 | Kojima et al. | |
| 5,195,316 | A | 3/1993 | Shinzawa et al. | |
| 5,207,807 | A | 5/1993 | Manfre et al. | |
| 5,458,673 | A * | 10/1995 | Kojima et al. | 95/11 |
| 5,472,462 | A | 12/1995 | Pischinger et al. | |
| 5,616,835 | A | 4/1997 | Schnaibel et al. | |
| 5,711,149 | A | 1/1998 | Araki | |
| 5,716,586 | A * | 2/1998 | Taniguchi | 422/173 |
| 5,732,550 | A * | 3/1998 | Muramatsu et al. | 60/274 |
| 5,839,279 | A * | 11/1998 | Moriya et al. | 60/445 |
| 6,013,118 | A | 1/2000 | Matsunuma et al. | |
| 6,050,086 | A * | 4/2000 | Ishizuka et al. | 60/274 |

(Continued)

FOREIGN PATENT DOCUMENTS

| | | |
|---|---|---|
| CN | 1535351 | 10/2004 |
| CN | 1540143 | 10/2004 |

(Continued)

*Primary Examiner* — Kenneth Bomberg
*Assistant Examiner* — Anthony Ayala Delgado

(57) ABSTRACT

A method for controlling an engine includes receiving a request to regenerate a particulate matter filter and regulating, in response to the request, operation of the engine and an electric heater that heats an inlet surface of the filter such that for a first period, the heater maintains the inlet surface within a first temperature range above a regeneration temperature of the filter and combustion of a first mass of accumulated PM within the filter is initiated, for a second period following the first period, exhaust cools the inlet surface to within a second temperature range below the regeneration temperature and combustion of the first mass is inhibited, and for a third period following the second period, the inlet surface is maintained within a third temperature range above the regeneration temperature and a second mass of the accumulated PM is combusted. A related control system is also provided.

21 Claims, 10 Drawing Sheets

(56) References Cited

U.S. PATENT DOCUMENTS

| | | | | |
|---|---|---|---|---|
| 6,090,172 | A | 7/2000 | Dementhon et al. | |
| 6,167,696 | B1 | 1/2001 | Maaseidvaag et al. | |
| 6,176,896 | B1 * | 1/2001 | Dementhon et al. | 95/14 |
| 6,405,528 | B1 | 6/2002 | Christen et al. | |
| 6,634,170 | B2 | 10/2003 | Hiranuma et al. | |
| 6,769,246 | B2 | 8/2004 | Strohmaier et al. | |
| 6,781,098 | B2 * | 8/2004 | Toyoda | 219/501 |
| 6,973,778 | B2 * | 12/2005 | Kondou et al. | 60/295 |
| 7,062,904 | B1 | 6/2006 | Hu et al. | |
| 7,073,326 | B2 * | 7/2006 | Cheong | 60/295 |
| 7,111,455 | B2 | 9/2006 | Okugawa et al. | |
| 7,146,804 | B2 | 12/2006 | Yahata et al. | |
| 7,171,801 | B2 | 2/2007 | Verkiel et al. | |
| 7,288,137 | B2 | 10/2007 | Iyer et al. | |
| 7,340,887 | B2 | 3/2008 | Ante et al. | |
| 7,412,822 | B2 | 8/2008 | Zhan et al. | |
| 7,607,295 | B2 | 10/2009 | Yokoyama et al. | |
| 7,615,725 | B2 * | 11/2009 | Kosaka et al. | 219/483 |
| 7,631,493 | B2 | 12/2009 | Shirakawa et al. | |
| 7,685,811 | B2 | 3/2010 | Taylor et al. | |
| 7,794,528 | B2 | 9/2010 | Tochikawa et al. | |
| 7,886,529 | B2 | 2/2011 | Gonze et al. | |
| 7,896,956 | B2 | 3/2011 | Takase et al. | |
| 7,901,475 | B2 | 3/2011 | Gonze et al. | |
| 8,037,673 | B2 | 10/2011 | Gonze et al. | |
| 8,146,350 | B2 | 4/2012 | Bhatia et al. | |
| 8,292,987 | B2 * | 10/2012 | Gonze et al. | 95/1 |
| 2003/0000188 | A1 | 1/2003 | Harada et al. | |
| 2003/0113249 | A1 | 6/2003 | Hepburn et al. | |
| 2003/0131592 | A1 | 7/2003 | Saito et al. | |
| 2004/0134187 | A1 | 7/2004 | Inoue et al. | |
| 2004/0194450 | A1 * | 10/2004 | Tanaka et al. | 60/285 |
| 2005/0072141 | A1 * | 4/2005 | Kitahara | 60/297 |
| 2005/0198944 | A1 | 9/2005 | Saitoh et al. | |
| 2006/0075731 | A1 | 4/2006 | Ohno et al. | |
| 2006/0254265 | A1 | 11/2006 | Odajima et al. | |
| 2007/0062181 | A1 * | 3/2007 | Williamson et al. | 60/297 |
| 2007/0137186 | A1 | 6/2007 | Igarashi | |
| 2007/0214778 | A1 | 9/2007 | Narita et al. | |
| 2007/0220869 | A1 | 9/2007 | Gonze et al. | |
| 2007/0220870 | A1 | 9/2007 | Gonze et al. | |
| 2007/0227104 | A1 * | 10/2007 | Gonze et al. | 55/282.3 |
| 2007/0245721 | A1 | 10/2007 | Colignon | |
| 2008/0041035 | A1 | 2/2008 | Sawada et al. | |
| 2008/0083212 | A1 | 4/2008 | Ament et al. | |
| 2008/0295483 | A1 | 12/2008 | Scaife et al. | |
| 2009/0064664 | A1 | 3/2009 | Hirata et al. | |
| 2009/0071128 | A1 | 3/2009 | Gonze et al. | |
| 2009/0113883 | A1 | 5/2009 | Bhatia et al. | |
| 2009/0158715 | A1 | 6/2009 | Stroh et al. | |
| 2009/0183501 | A1 | 7/2009 | Gonze et al. | |
| 2009/0288398 | A1 * | 11/2009 | Perfetto et al. | 60/287 |
| 2010/0095657 | A1 | 4/2010 | Gonze et al. | |
| 2010/0126145 | A1 | 5/2010 | He et al. | |

FOREIGN PATENT DOCUMENTS

| | | | |
|---|---|---|---|
| CN | 101091038 | A | 12/2007 |
| CN | 101429884 | A | 5/2009 |
| DE | 102008046706 | | 4/2009 |
| DE | 102008046924 | | 4/2009 |
| DE | 102008050169 | | 5/2009 |
| GB | 2454341 | A | 6/2009 |
| JP | 06221138 | | 8/1994 |
| JP | 2000-297625 | | 10/2000 |

* cited by examiner

SYSTEMS AND METHODS FOR LAYERED REGENERATION OF A PARTICULATE MATTER FILTER

FIELD

The present disclosure relates to vehicle exhaust treatment systems, and more particularly, to control systems and methods for regenerating particulate matter filters.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Diesel engines combust diesel fuel in the presence of air to produce power. The combustion of diesel fuel produces exhaust that contains particulate matter (PM). The PM may be filtered from the exhaust by a PM filter. Over time, the PM may accumulate within the PM filter and may restrict the flow of exhaust through the PM filter. PM that has collected within the PM filter may be removed by a process referred to as regeneration. During regeneration, PM within the PM filter may be combusted.

Regeneration may be accomplished, for example, by injecting fuel into the flow of exhaust upstream of the PM filter and combusting the injected fuel. Combustion of the injected fuel generates heat, thereby increasing the temperature of the exhaust entering the PM filter. The increased temperature of the exhaust may cause PM accumulated within the PM filter to combust. A resistive heater may be located at an upstream end of the PM filter to supply additional heat to the exhaust entering the PM filter.

SUMMARY

In one form, the present disclosure provides an exemplary control system for an engine that includes an input that receives a request to regenerate a PM filter that filters PM from exhaust of the engine, and a regeneration module that, in response to the request, regulates operation of the engine and an electric heater that heats an inlet surface of the PM filter for a first heating period, a cooling period following the first heating period, and a second heating period following the cooling period.

For the first heating period, the regeneration module regulates operation such that the electric heater maintains the inlet surface within a first inlet temperature range above a regeneration temperature of the PM filter and combustion of a first mass of accumulated PM within the PM filter is initiated. For the cooling period following the first heating period, the regeneration module regulates operation such that the exhaust cools the inlet surface to within a second inlet temperature range below the regeneration temperature and combustion of the first mass is inhibited. For the second heating period following the cooling period, the regeneration module regulates operation such that the inlet surface is maintained within a third inlet temperature range above the regeneration temperature and a second mass of the accumulated PM is combusted.

In one feature, the cooling period is less than the first heating period and the second heating period. In other features, the first heating period may be less than the second heating period, and the second heating period may immediately follow the cooling period. In yet another feature, the first heating period may be based on one of a first exhaust temperature of the exhaust and a concentration of oxygen in the exhaust. In still another feature, during the first heating period, the electric heater may maintain the inlet surface at a target inlet temperature that is based on one of the first exhaust temperature of the exhaust and the concentration of oxygen in the exhaust. In still another feature, first temperatures that bound the first inlet temperature range may be greater than second temperatures that bound the third inlet temperature range.

In an exemplary embodiment, the present disclosure provides a control system for an engine that includes an input that receives a request to regenerate a PM filter that filters PM from exhaust of the engine, and a regeneration module that, in response to the request, regulates operation of the engine and resistive coils of an electric heater that heat zones of an inlet surface of the PM filter such that portions of accumulated PM within the PM filter corresponding to the zones are combusted and subsequently a remaining portion of accumulated PM is combusted.

In particular, the regeneration module regulates operation such that for a first heating period, a first resistive coil of the electric heater maintains a first zone of the inlet surface within a first inlet temperature range above a regeneration temperature of the PM filter and combustion of a first mass of accumulated PM within the PM filter is initiated, and for a second heating period, a second resistive coil of the electric heater maintains a second zone of the inlet surface within the first inlet temperature range and combustion of a second mass of accumulated PM within the PM filter is initiated. The regeneration module further regulates operation such that for a first cooling period following the first heating period, exhaust of the engine cools the first zone to within a second inlet temperature range below the regeneration temperature and combustion of the first mass is inhibited, and for a second cooling period following the second heating period, exhaust of the engine cools the second zone to within the second inlet temperature range and combustion of the second mass is inhibited. Subsequently, the regeneration module regulates operation such that for a third heating period following the first and second cooling periods, the inlet surface is maintained within a third inlet temperature range above the regeneration temperature and a third mass of the accumulated PM is combusted.

In the exemplary embodiment, the second heating period may follow the first cooling period. In related features, the first and second cooling periods may be less than the first, second, and third heating periods, and the third heating period may immediately follow the second cooling period. In other features, first temperatures that bound the first inlet temperature range may be greater than second temperatures that bound the third inlet temperature range.

In another form, the present disclosure provides an exemplary method for controlling an engine that includes receiving a request to regenerate a PM filter that filters PM from exhaust of the engine, and regulating, in response to the request, operation of the engine and an electric heater that heats an inlet surface of the PM filter for a first heating period, a cooling period following the first heating period, and a second heating period following the cooling period.

For the first heating period, the regulating operation includes regulating operation such that the electric heater maintains the inlet surface within a first inlet temperature range above a regeneration temperature of the PM filter and combustion of a first mass of accumulated PM within the PM filter is initiated. For the cooling period following the first heating period, the regulating operation includes regulating operation such that the exhaust cools the inlet surface to within a second inlet temperature range below the regeneration temperature and combustion of the first mass is inhibited. For the second heating period following the cooling period, the regulating operation includes regulating operation such that the inlet surface is maintained within a third inlet temperature range above the regeneration temperature and a second mass of the accumulated PM is combusted.

In related features, the cooling period may be less than the first heating period and the second heating period, and the first heating period may be less than the second heating period. In another related feature, the second heating period may immediately follow the cooling period.

In further features, the first heating period may be based on one of a first exhaust temperature of the exhaust and a concentration of oxygen in the exhaust. During the first heating period, the electric heater may maintain the inlet surface at a target inlet temperature that is based on one of the first exhaust temperature of the exhaust and the concentration of oxygen in the exhaust.

In still further features, first temperatures that bound the first inlet temperature range may be greater than second temperatures that bound the third inlet temperature range. The first inlet temperature range may include temperatures between 700° C. and 800° C. An exhaust temperature of the exhaust during the cooling period may be less than 450° C.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
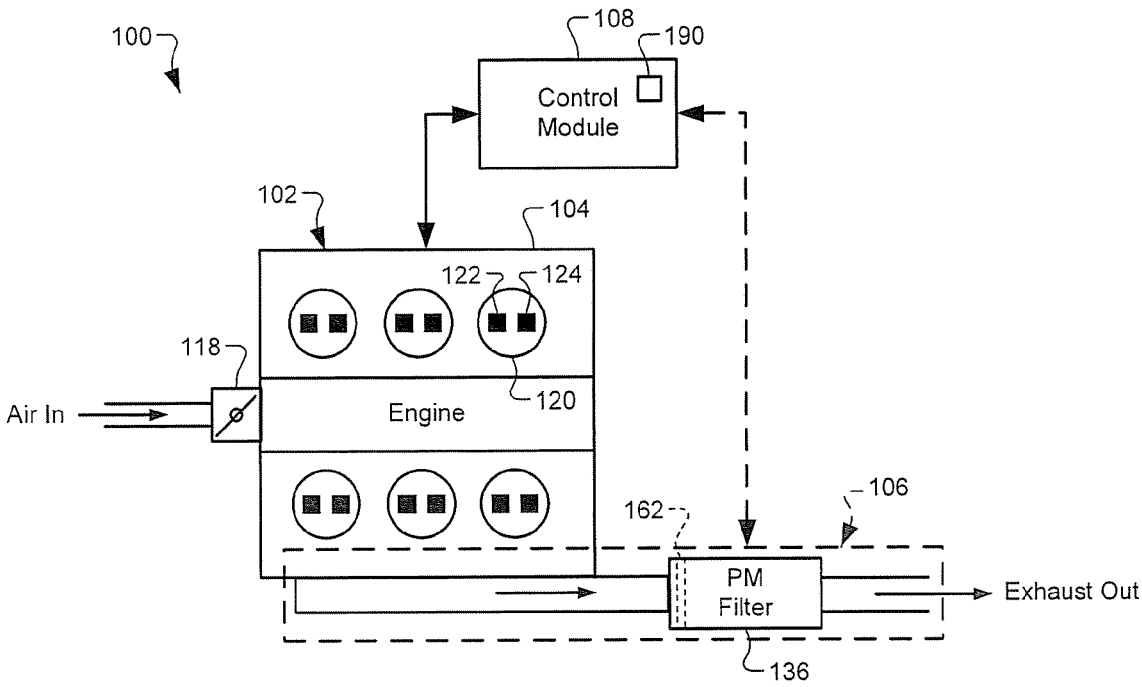
FIG. 1 is functional block diagram of an exemplary engine and exhaust system according to the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory including one or more software or firmware programs, and/or a combinational logic circuit that provides the described functionality.

During regeneration of the PM filter, heat produced by the combustion of PM may cause the temperature of the PM filter to rise. If the temperature of the PM filter becomes excessive, damage to the PM filter may result. The present disclosure provides an exemplary control system and methods for lowering the maximum temperature of the PM filter during regeneration. According to the principles set forth in more detail below, the maximum temperature may be lowered by regenerating the PM filter using a layered regeneration process.

The layered regeneration process may include a first combustion process during which a portion of the PM accumulated within the PM filter is combusted and a second combustion process during which the remaining accumulated PM is combusted. During the first combustion process, the temperature of the exhaust exiting the engine is maintained below the regeneration temperature of the PM filter. As discussed herein, the term regeneration temperature will be used to refer to a temperature of the PM filter above which combustion of the PM accumulated within the PM filter will occur.

While maintaining the temperature of the exhaust below the regeneration temperature, heat is supplied to the exhaust entering the PM filter such that the temperature of an inlet surface of the PM filter is raised to within a temperature range above the regeneration temperature for a first period. Raising the inlet surface above the regeneration temperature initiates combustion of the accumulated PM. During a second period following the first period, the exhaust cools the inlet surface below the regeneration temperature. The second period is a period of cooling sufficient to inhibit continued combustion and will generally be less than the first period and the subsequent period during which the second combustion process is carried out.

By regulating the temperatures of the exhaust and the inlet surface in the foregoing manner, combustion during the first combustion process may be limited to a portion of the accumulated PM. In particular, combustion may be limited to a surface layer of the accumulated PM. Zones of the inlet surface may be sequentially heated to sequentially combust portions of PM accumulated within individual corresponding volumes of the PM filter. An electric heater located at an upstream end of the PM filter may supply the heat that raises the temperature of the inlet surface.

During the second combustion process, the remaining PM accumulated within the PM filter is removed by combustion. The remaining PM may be combusted using conventional methods for regenerating the PM filter. Where the PM accumulated in two or more volumes are sequentially combusted in the first combustion process, the second combustion process for one of the volumes may commence prior to the completion of the first combustion process of another volume.

By removing a portion of the PM during the first combustion process, the mass of PM combusted during the subsequent second combustion process may be lowered. By lowering the mass of PM, the amount of heat produced during the second combustion process may be reduced, resulting in lower maximum temperatures of the PM filter.

With reference to FIG. 1, a functional block diagram of an exemplary engine and exhaust system 100 according to the present disclosure is shown. The engine and exhaust system 100 may include a diesel engine system 102. While a diesel engine system is shown, the present disclosure is applicable to gasoline engine systems, homogenous charge compression ignition engine systems, and/or other engine systems.

The diesel engine system 102 includes an engine 104, an exhaust system 106, and a control module 108 that regulates operation of the engine 104 and the exhaust system 106. The engine 104 draws air through a throttle 118 into cylinders 120 and combusts a mixture of the air and diesel fuel in the cylinders 120 to produce power (e.g., torque). Fuel may be supplied to each of the cylinders 120 by one or more fuel injectors 122. Combustion within the cylinders 120 may be initiated by one or more spark plugs 124. While the engine 104 shown includes six cylinders 120, the engine 104 may have additional or fewer cylinders.

Combustion of the air and fuel mixture produces hot exhaust that may be expelled from the engine 104 into the exhaust system 106. The exhaust produced by the engine 104 may contain a mixture of gaseous compounds and PM that enters the exhaust system 106. The gaseous compounds and PM may be treated prior to exiting the exhaust system 106 into the surroundings.

Figure 2:
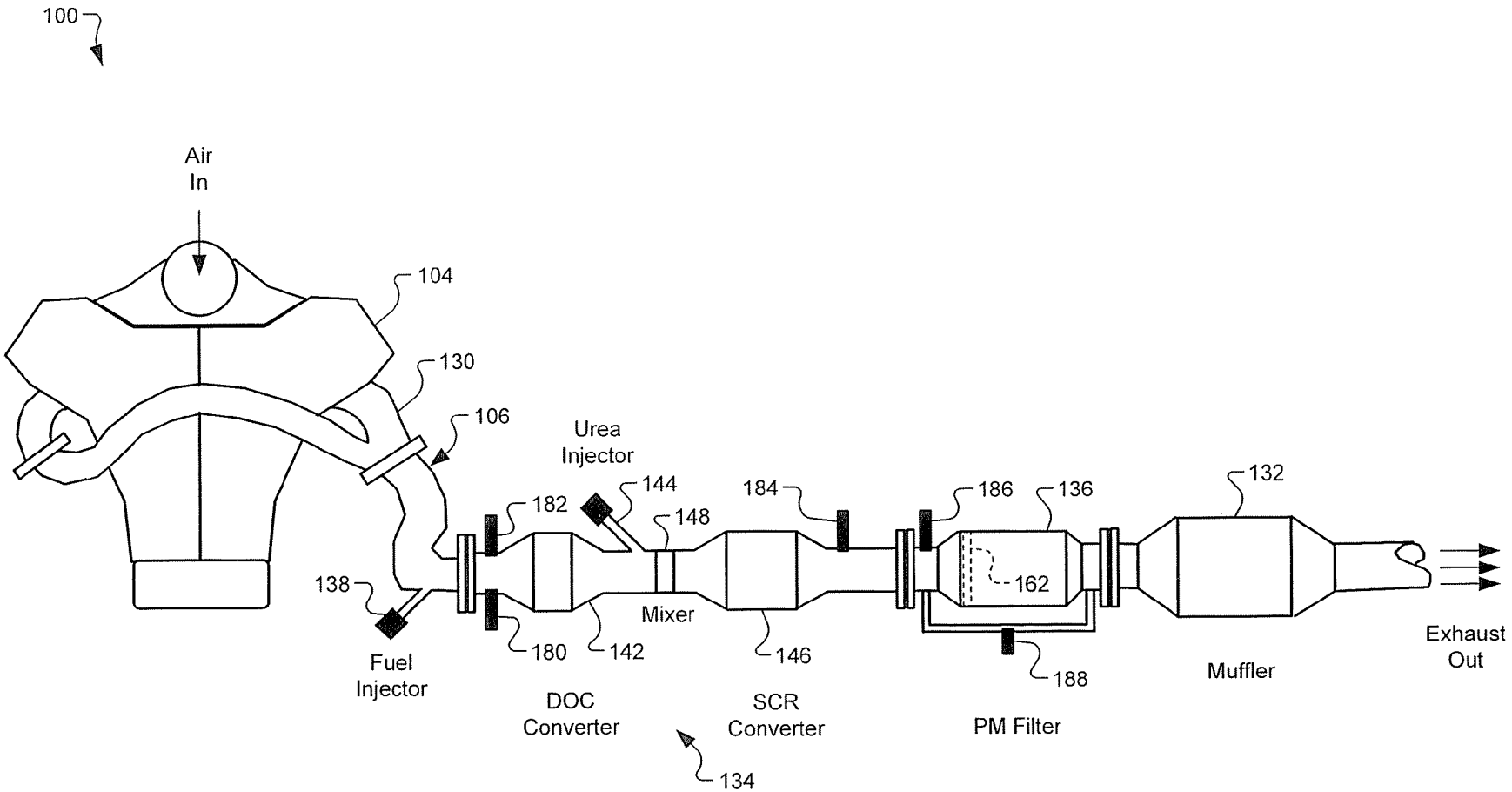
FIG. 2 is a schematic view of a portion of the engine and exhaust system shown in FIG. 1.

With particular reference to FIG. 2, the exhaust system 106 may include an exhaust manifold 130, a muffler 132, a selective catalytic reduction (SCR) system 134, a PM filter 136, and a secondary fuel injector 138. Exhaust produced by the engine 104 enters the exhaust system 106 via the exhaust manifold 130 and exits through the muffler 132. The SCR system 134 may reduce the concentration of nitrogen oxides (NOx) in the exhaust. The SCR system 134 may include a diesel oxidation-type catalytic (DOC) converter 142, a urea injector 144, and an SCR catalytic converter 146 connected by exhaust pipe as shown. The SCR system 134 may also include a mixer 148 disposed in the exhaust downstream of the urea injector 144 that promotes mixing of the exhaust and the urea injected into the exhaust by the urea injector 144.

Figure 3:
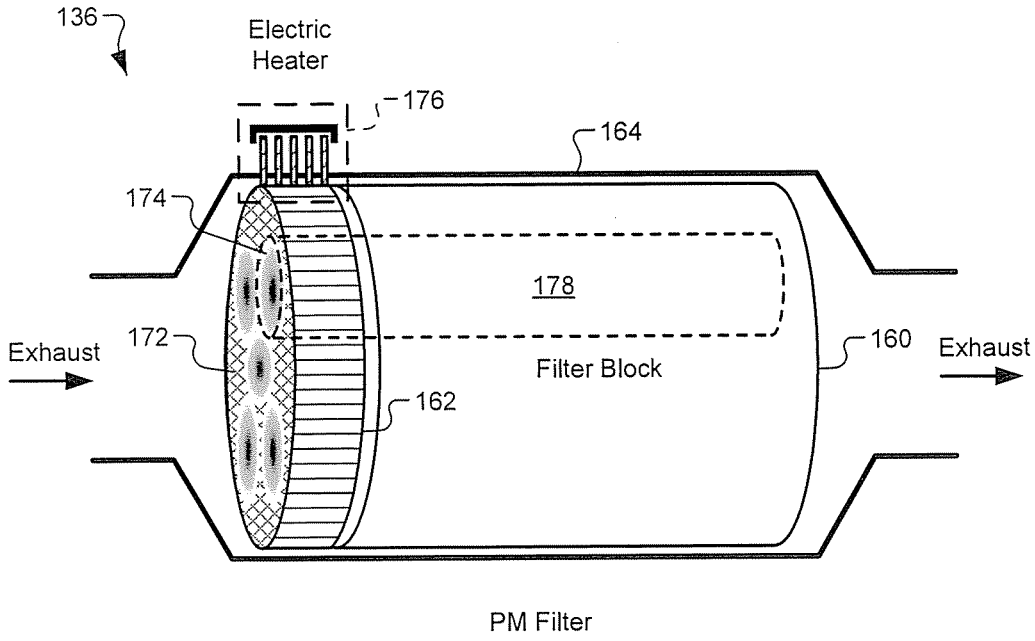
FIG. 3. is a side view of the PM filter shown in FIG. 1.

The PM filter 136 may remove PM from the exhaust. With particular reference to FIG. 3, the PM filter 136 may include a filter block 160 and an electric heater 162 housed within a housing 164. The filter block 160 may be of any conventional type, and may be made of, for example, cordierite. The electric heater 162 may be located at an upstream end of the filter block 160 and may include resistive coils 170 (FIG. 4) that are arranged across an inlet surface 172 and thereby define heating zones 174. Power may be individually supplied to each of the resistive coils 170 via a connector 176. In this manner, each of the resistive coils 170 may be independently actuated.

Figure 4:
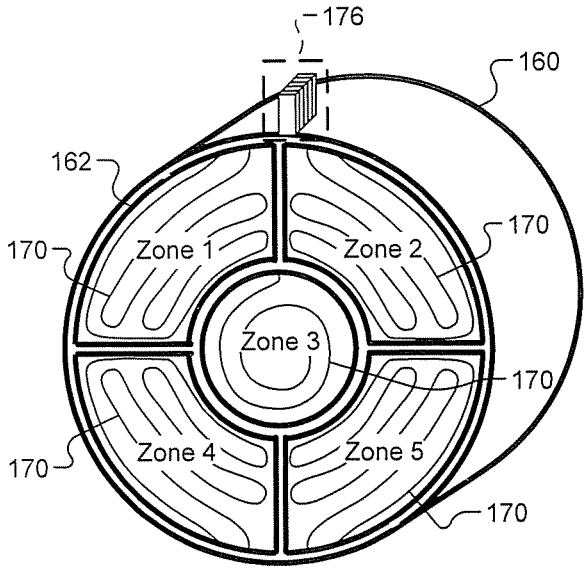
FIG. 4 is a perspective view of a portion of the PM filter shown in FIG. 1.

With particular reference to FIG. 4, the electric heater 162 may include five resistive coils 170 defining five heating zones 174 as shown. It will be appreciated that additional or fewer resistive coils 170 may be provided. The number and arrangement of the resistive coils 170 may be dependent on the area of the inlet surface 172 and a surface power density desired for each of the heating zones 174. The number and arrangement may also be dependent on a mass flow rate of the exhaust through each of the heating zones 174. Additionally, as discussed herein, the number of resistive coils 170 provided may be dependent on a projected volume 178 (FIG. 3) within the filter block 160 defined by each of the resistive coils 170.

Referring again to FIG. 2, the fuel injector 138 may be located upstream of the DOC converter 142 as shown. The fuel injector 138 may inject fuel into the exhaust that is combusted downstream and thereby raises the temperature of the exhaust. Fuel may be injected in the exhaust to assist regeneration of the PM filter 136 as disclosed in further detail below.

The exhaust system 106 may further include sensors that sense one or more operating conditions of the exhaust, such as exhaust temperature and pressure, and a concentration of NOx in the exhaust. For example only, the exhaust system 106 may include a first NOx sensor 180, a first temperature sensor 182, a second NOx sensor 184, a second temperature sensor 186, and a differential pressure sensor 188. The sensors 180-188 may generate signals based on the operating condition sensed. Collectively, the signals generated by the sensors located in the exhaust system 106, such as the foregoing sensors 180-188, will be referred to hereinafter and in the figures as "exhaust signals".

The first NOx sensor 180 and the first temperature sensor 182 may be located upstream of the DOC converter 142. The first NOx sensor 180 may sense a concentration of NOx present in the exhaust entering the SCR system 134, and may generate an output signal based on the concentration sensed. The first temperature sensor 182 may sense a temperature of the exhaust entering the SCR system 134, and may generate an output signal based on the temperature sensed.

The second NOx sensor 184 may be located downstream of the SCR catalytic converter 146. The second NOx sensor 184 may sense a concentration of NOx in the exhaust exiting the SCR system 134, and may generate an output signal based on the concentration sensed. The output signals generated by the NOx sensors 180, 184 may also be used to determine the concentration of oxygen in the exhaust.

The second temperature sensor 186 may be located at an upstream end of the PM filter 136 and may sense a temperature of the exhaust entering the PM filter 136. The second temperature sensor 186 may generate an output signal based on the temperature sensed.

The differential pressure sensor 188 may be fluidly coupled to the upstream end and a downstream end of the PM filter 136. The differential pressure sensor 188 may sense a difference between a first pressure of the exhaust entering the PM filter 136 and a second pressure of the exhaust exiting the PM filter 136. The differential pressure sensor 188 may generate an output signal based on the difference in the first and second pressures sensed. The output signal generated by the differential pressure sensor 188 may be used to determine a back pressure of the PM filter 136.

Referring again to FIG. 1, the control module 108 regulates operation of the engine 104 and the exhaust system 106. The control module 108 may regulate operation based on signals generated by engine sensors (not shown) that measure one or more operating conditions of the engine 104. The operating conditions may include, for example, mass air flow into the engine and engine coolant temperature. Collectively, the signals generated by the engine sensors will be referred to hereinafter and in the figures as "engine signals". The control module 108 may further regulate operation based on the exhaust signals.

The control module 108 may regulate operation by controlling actuators that vary operating conditions of the engine 104, such as, but not limited to, intake air supply, fuel supply, and spark timing. As one example, the control module 108 may regulate the mass air flow into the engine 104 by controlling the throttle 118. The control module 108 may further regulate operation by controlling exhaust actuators that vary operating conditions of the exhaust system 106. For example, the control module 108 may regulate the mass of urea injected into the exhaust by controlling the urea injector 144. The control module 108 may include one or more modules, such as an exhaust system module 190, that regulate the various operating conditions.

Figure 5:
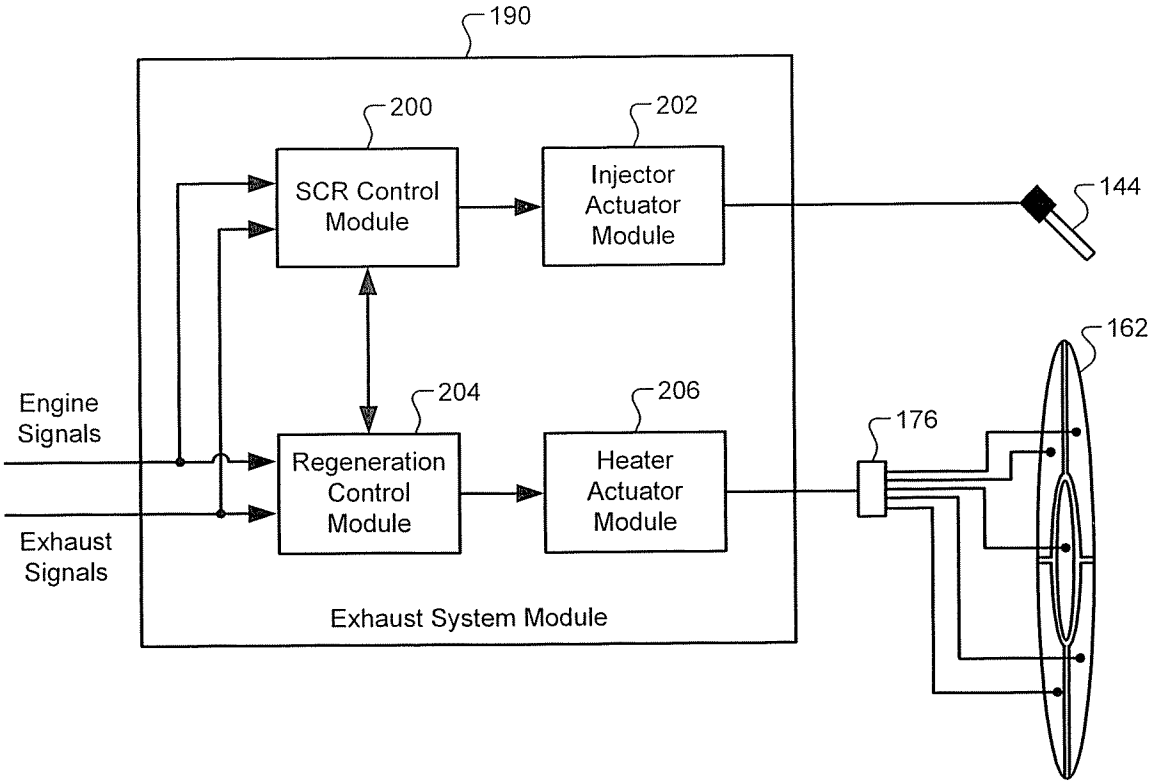
FIG. 5. is a functional block diagram illustrating an exemplary control system for controlling the electric heater shown in FIG. 3.

With particular reference to FIG. 5, the exhaust system module 190 will now be described in detail. The exhaust system module 190 works together with other modules of the control module 108 and thereby regulates operation of the engine 104 and the exhaust system 106 according to the present disclosure. In particular, the exhaust system module 190 regulates operation when regeneration of the PM filter 136 is desired.

The exhaust system module 190 may include an SCR control module 200, an injector actuator module 202, a regeneration control module 204 and a heater actuator module 206. The SCR control module 200 may regulate operation of the SCR system 134 via the injector actuator module 202 and thereby regulate the concentration of NOx in the exhaust. The SCR control module 200 may output SCR system control values, such as a desired mass of urea to be injected into the exhaust, that are received by the injector actuator module 202. The injector actuator module 202 may control operation of the urea injector 144 based on the control values received.

The regeneration control module 204 determines whether to regenerate the PM filter 136. When regeneration is desired, the regeneration control module 204 works together with other modules to regulate operation during periods prior to and during the layered regeneration process of the present disclosure. Prior to the layered regeneration process, the regeneration control module 204 may adjust operating conditions such that during the layered regeneration process, exhaust emissions may be maintained within desired limits. For example only, the regeneration control module 204 may work together with the SCR system 134 to adjust ammonia storage within the PM filter 136 and thereby regulate NOx emissions during the subsequent layered regeneration process. Prior to and during the layered regeneration process, the regeneration control module 204 may adjust the temperature of the exhaust exiting the engine 104. During the layered regeneration process, the regeneration control module 204 may regulate the electric heater 162 via the heater actuator module 206. By regulating the electric heater 162, the regeneration control module 204 may adjust the temperature of the inlet surface 172.

Figure 6:
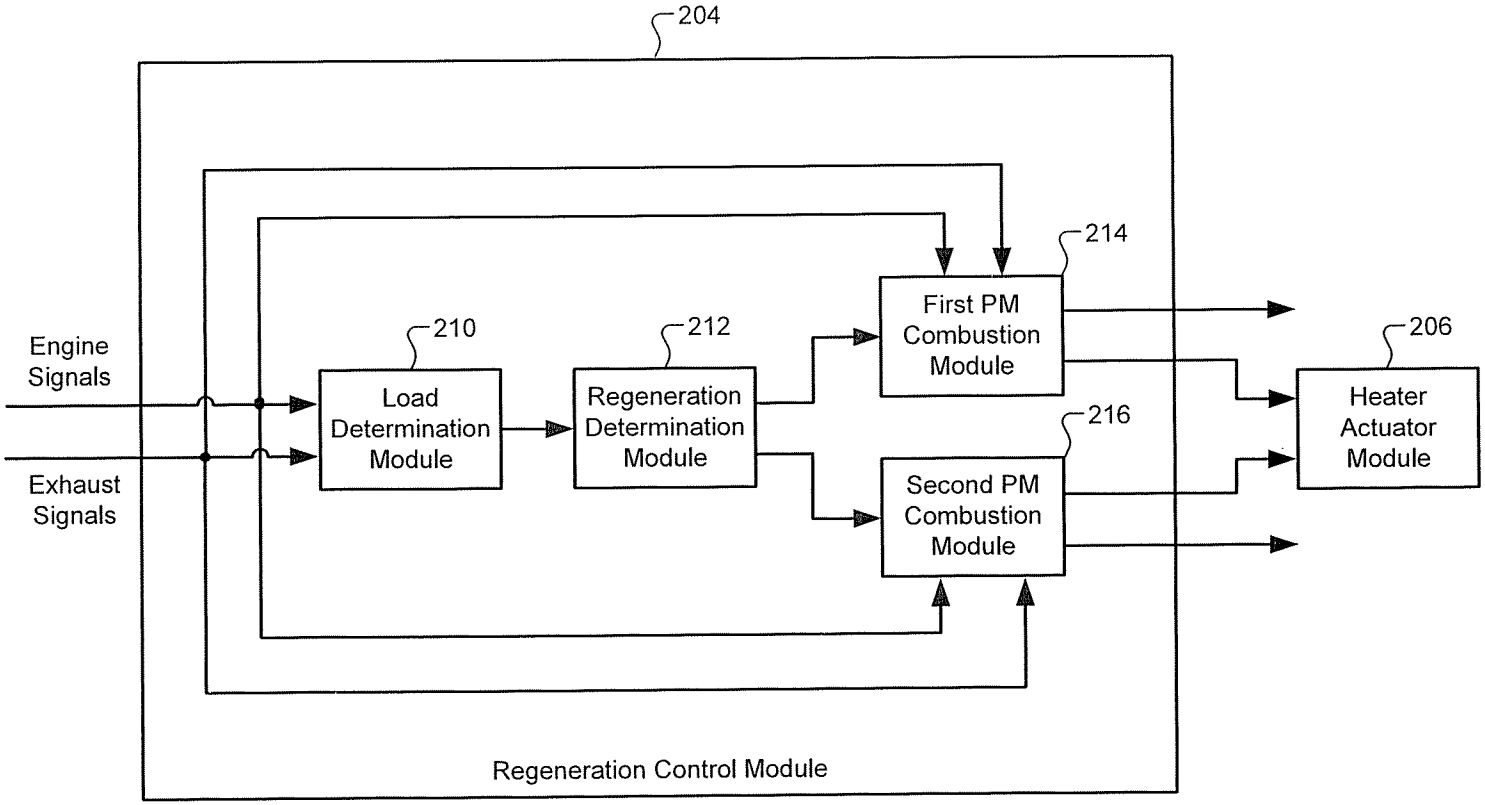
FIG. 6 is a functional block diagram illustrating the regeneration control module shown in FIG. 5.

With particular reference to FIG. 6, an exemplary embodiment of the regeneration control module 204 is shown. The regeneration control module 204 includes a load determination module 210, a regeneration determination module 212, a first PM combustion module 214, and a second PM combustion module 216. The load determination module 210 receives one or more of the engine and exhaust signals and determines a PM load of the PM filter 136 based on the signals received. The load determination module 210 may determine the PM load according to conventional methods. For example, the PM load may be determined based on engine run time, and/or the back pressure generated by the PM filter 136. Accordingly, the load determination module 210 may determine the PM load based on the differential pressure sensed by the differential pressure sensor 188.

The PM load may be an estimated mass of PM accumulated within the PM filter 136. Alternately, the PM load may be a value based on the estimated mass of PM accumulated, such as a ratio of the estimated mass of PM accumulated and a target mass of PM below which the PM filter 136 should be operated. The load determination module 210 may output the PM load to the regeneration determination module 212.

The regeneration determination module 212 may determine whether to request regeneration of the PM filter 136 based on the PM load. For example, the regeneration determination module 212 may determine whether to request regeneration by comparing the PM load and a predetermined threshold load. The threshold load may be a predetermined value stored in memory above which regeneration should be performed. The threshold load may be determined by empirical methods. The regeneration determination module 212 outputs a regeneration request indicating whether to regenerate the PM filter 136. The regeneration determination module 212 may output the regeneration request to the first and second PM combustion modules 214, 216.

The first and second PM combustion modules 214, 216 may receive the regeneration request and may work together to regenerate the PM filter 136 when regeneration has been requested. As discussed in further detail below, the first and second PM combustion modules 214, 216 may regulate temperatures of the exhaust exiting the engine 104 and the inlet surface 172 of the PM filter 136 during a first combustion process and a second combustion process, respectively. The first and second PM combustion modules 214, 216 may regulate operation based on one or more engine and exhaust signals received. The first and second PM combustion modules 214, 216 may also generate control values that are used to adjust operating conditions and thereby regulate operation.

The first PM combustion module 214 may regulate operation of the engine 104 and exhaust system 106 such that a portion of the PM accumulated in the PM filter 136 is combusted in the first combustion process. The first PM combustion module 214 may regulate operation such that a portion of the PM in the projected volume 178 of two or more heating zones 174 is combusted.

During the first heating period, the first PM combustion module 214 may regulate the engine 104 such that the exhaust exiting the engine 104 is at a first target engine-out exhaust temperature in a first exhaust temperature range below the regeneration temperature. For example only, the first exhaust temperature range may include temperatures less than or equal to 450° C.

During the first heating period, the first PM combustion module 214 may further regulate the electric heater 162 to supply heat to the exhaust such that the inlet surface 172 of the PM filter 136 is heated to a first target inlet temperature in a first inlet temperature range above the regeneration temperature. For example only, the first inlet temperature range may include temperatures between 700° C. and 800° C.

During a cooling period following the first heating period, the first PM combustion module 214 may regulate operation such that the inlet surface 172 is cooled below the regeneration temperature. The first PM combustion module 214 may de-actuate the electric heater 162 and regulate the engine 104 such that the exhaust exiting the engine 104 is maintained within the first exhaust temperature range. In this manner, the exhaust may be used to cool the inlet surface 172 below the regeneration temperature in a relatively short period of time and thereby inhibit continued combustion.

The first PM combustion module 214 may communicate heater control values that are used by the heater actuator module 206 to control operation of the electric heater 162 during the first heating period. The heater control values may correspond to the first target inlet temperature and the first inlet temperature range, periods of actuating each of the resistive coils 170, a sequence of actuating the heating zones 174, and target exhaust temperatures for each of the heating zones 174. The first PM combustion module 214 may generate the heater control values based on the temperature of the exhaust exiting the engine and/or a concentration of oxygen in the exhaust. The first PM combustion module 214 may communicate other control values that are used for regulating operation during the first heating period.

The second PM combustion module 216 may regulate operation of the engine 104 and exhaust system 106 during a second heating period such that a remaining portion of the accumulated PM is combusted in the second combustion process. During the second heating period, the second PM combustion module 216 may regulate operation such that the inlet surface 172 is heated to a second target inlet temperature in a second inlet temperature range above the regeneration temperature. For example only, the second inlet temperature range may include temperatures between 550° C. and 650° C. While the second inlet temperature range may include temperatures below the first inlet temperature range as disclosed herein, it should be understood that the second inlet temperature range may include higher temperatures. The second inlet temperature range may include temperatures in the first inlet temperature range.

The heater actuator module 206 receives the heater control values and may control operation of the electric heater 162 based on the heater control values received. The heater actuator module 206 may selectively supply power to the resistive coils 170 via the connector 176.

Figure 7:
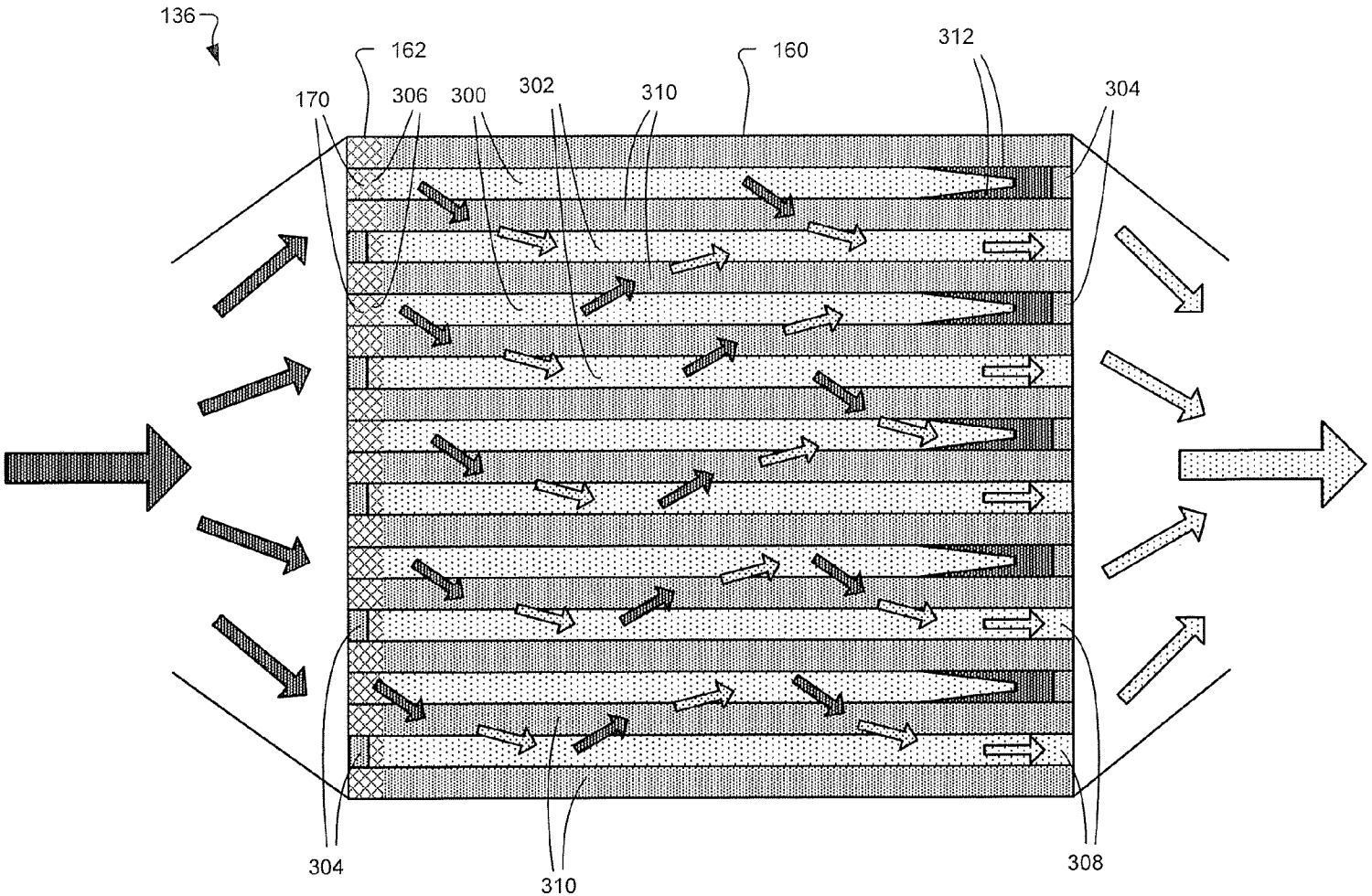
FIG. 7 is a cross-sectional view of a portion of the PM filter shown in FIG. 1.

With particular reference to FIG. 7, operation of the PM filter 136 to trap PM will now be discussed in further detail. Exhaust enters the upstream end of the PM filter 136 and flows across the resistive coils 170 prior to entering alternating closed channels 300 and open channels 302 of the filter block 160. Ends of the channels 300, 302 may be alternately sealed by plugs 304. Exhaust enters the filter block 160 through openings 306 located on the upstream end of the closed channels 300 and exits through openings 308 located on the downstream end of the open channels 302. Along the way, the exhaust passes through walls 310 of the channels 300, 302. PM in the exhaust is accumulated by the walls 310 and forms layers 312 along both sides of a length of the walls 310 between the upstream and downstream ends. The length and the thickness of the layers 312 may vary, depending on the configuration of the filter block 160 and the amount of accumulated PM.

Figure 8:
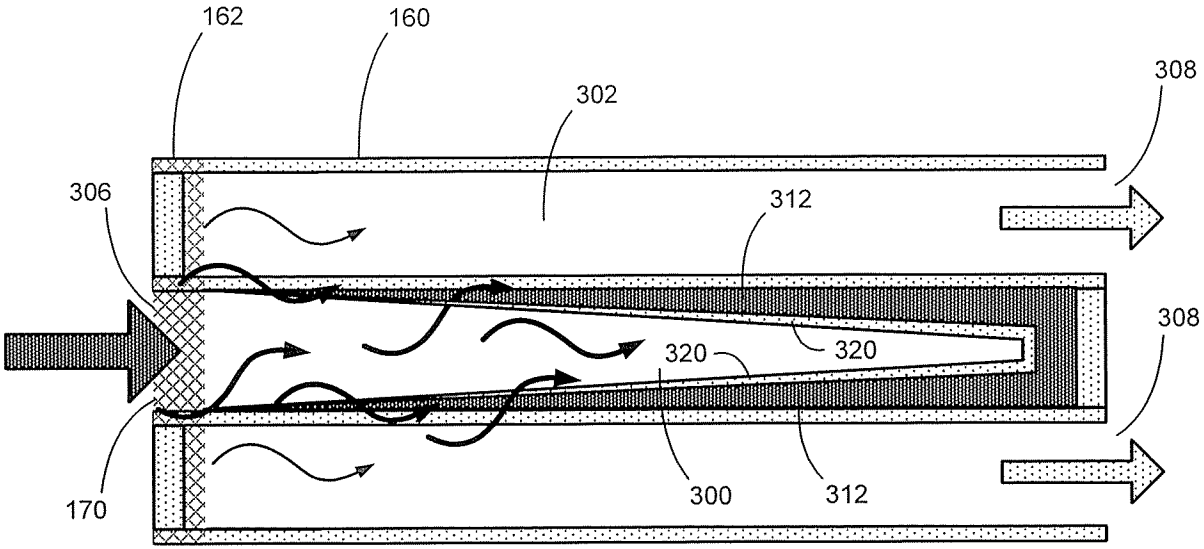
FIG. 8 is another cross-sectional view of a portion of the PM filter shown in FIG. 1.
Figure 9:
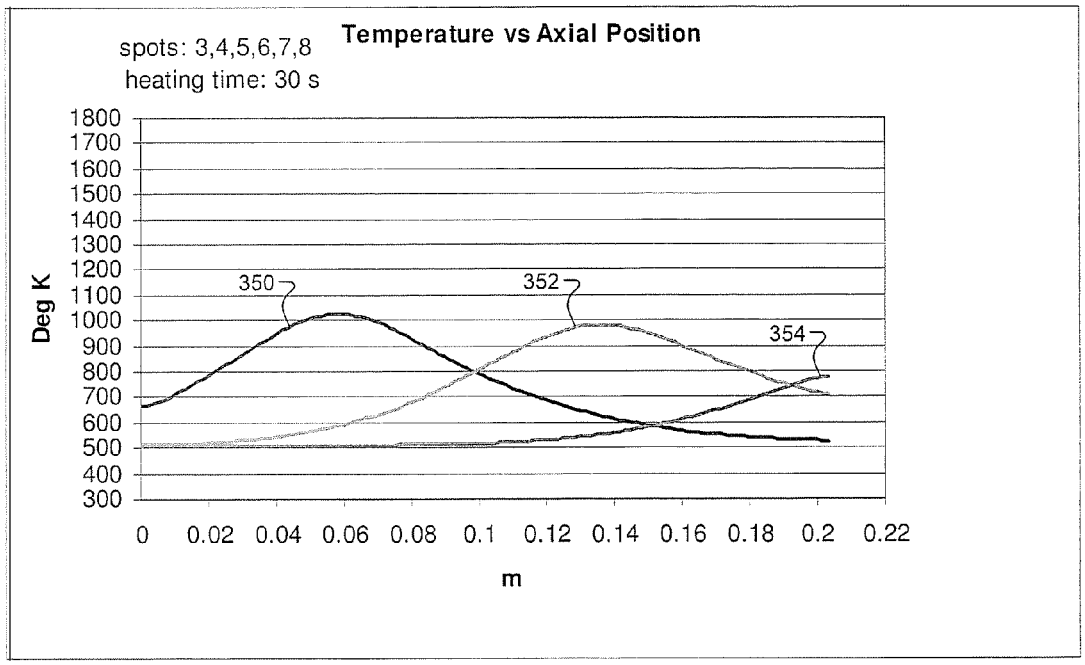
FIG. 9 is a chart illustrating exemplary temperatures of the PM filter during regeneration according to the present disclosure.
Figure 10:
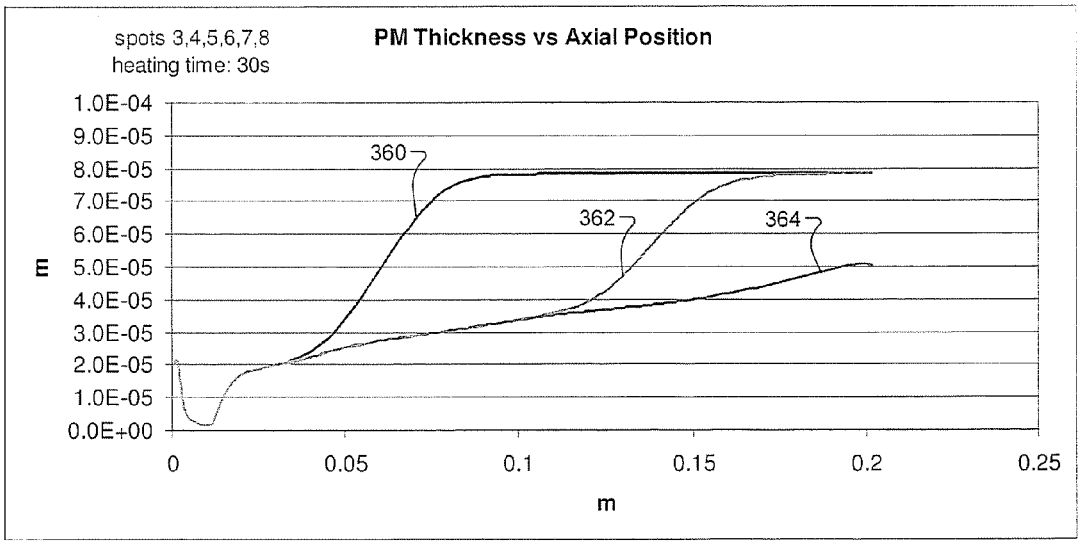
FIG. 10 is a chart illustrating exemplary PM layer thicknesses of the PM filter during regeneration according to the present disclosure.

Referring now to FIGS. 8-10, operation of the engine and exhaust system 100 to regenerate the PM filter 136 will now be discussed in further detail. With particular reference to FIG. 8, a portion of the PM filter 136 is shown. In particular, FIG. 8 illustrates the projected volume 178 for a single heating zone 174. For simplicity, a single closed channel 300 and two open channels 302 are illustrated. However, it should be understood that the projected volume 178 of each of the heating zones 174 may include additional or fewer channels 300, 302.

When regeneration of the PM filter 136 is requested, the first PM combustion module 214 commences the first combustion process. In the first combustion process, a portion of the PM accumulated within the PM filter 136 is combusted during the first heating period. The first combustion process may include combusting portions of PM accumulated in one or more of the projected volumes 178. In the first combustion process, a surface layer 320 of the layers 312 in one or more projected volume 178 is combusted. The surface layer 320 in each projected volume 178 may be combusted. Combustion of the surface layer 320 in each projected volume 178 may be initiated sequentially as discussed in further detail below. Alternatively, combustion of the surface layer 320 in two or more projected volumes 178 may be initiated at nearly the same time.

Subsequent to the first combustion process, the second PM combustion module 216 commences the second combustion process. In the second combustion process, a remaining mass of PM accumulated within the PM filter 136 is combusted during the second heating period. In this manner, the PM remaining in the layers 312 after the first combustion process may be combusted. Where the first combustion process includes sequential combustion in two or more projected volumes 178, the second combustion process may commence prior to completing the first combustion process for the affected projected volumes 178. For example, the second combustion process may commence in one projected volume 178 that has completed the first combustion process prior to completing the first combustion process in another projected volume 178.

With the foregoing in mind, during the first heating period the first PM combustion module 214 may regulate the engine 104 such that the exhaust exiting the engine 104 is at the first target engine-out exhaust temperature in the first exhaust temperature range. In this manner, the exhaust exiting the engine 104 may be maintained below the regeneration temperature. It will be appreciated that the temperature of the exhaust exiting the engine 104 during the first heating period may vary depending on other operating conditions, such as engine speed and/or a desired power output of the engine 104.

During the first heating period, the first PM combustion module 214 may further regulate the electric heater 162 such that the inlet surface 172 of the PM filter 136 is maintained at the first target inlet temperature in the first inlet temperature range. In particular, the first PM combustion module may actuate the resistive coils 170 of each of the heating zones 174 and thereby regulate the amount of heat supplied to the exhaust entering through each heating zone. Heat may be sequentially supplied in each of the heating zones 174 for a predetermined actuation period. The actuation period may be a single predetermined period, or may different for the various heating zones 174. For example only, the actuation period may be a single predetermined period of around sixty seconds.

The resistive coils 170 may each be actuated for the corresponding actuation period such that the temperature of the exhaust entering the channels 300, 302 during the actuation period is at or near a target zone inlet exhaust temperature for each of the heating zones 174. In general, the target zone inlet exhaust temperature is a temperature sufficient to raise the temperature of the inlet surface 172 above the regeneration temperature to the first target inlet temperature within the actuation period. In this manner, the first PM combustion module 214 may raise the temperature of the inlet surface 172 to a temperature sufficient to cause combustion of the surface layer 320 during the actuation period.

Combustion may be initiated within the surface layer 320 at or near the upstream end of the closed channels 300. Combustion may subsequently progress within the surface layer 320 along the length of the walls 310 towards the downstream end for the duration of the actuation period. Combustion of the surface layer 320 may continue for a short period following the actuation period before coming to an end.

During the actuation period, the heat supplied by the resistive coils 170, when combined with the heat produced during combustion of the PM, may be sufficient to cause combustion of the surface layer 320 along the length of the walls 310. However, in general, the heat produced during combustion is insufficient to prolong combustion once the actuation period has ended. Once the actuation period has ended, combustion is inhibited by the cooler temperatures of the exhaust entering the channels 300, 302. Thus, at the end of the actuation periods for each of the heating zones 174, a portion of the layers 312 within each projected volume 178 will generally remain.

FIGS. 9-10 provide charts of PM filter temperature and PM layer thickness illustrating combustion of the surface layer 320 in the first combustion process. In particular, the charts of FIGS. 9-10 illustrate combustion during a heating period equal to thirty seconds. FIG. 9 is an exemplary chart of temperature versus axial position that illustrates the progression of combustion along the length of the filter block 160. In the chart, temperatures along the length measured at time intervals of 61 seconds, 120 seconds, and 240 seconds after initiating combustion are plotted in temperature traces 350, 352, 354, respectively. Peaks in the temperature traces 350, 352, 354 illustrate the progression of combustion along the length. As seen in the chart, the peaks progress along the length during the thirty second heating period and continue for a period thereafter.

FIG. 10 is a chart that plots the thickness of the PM layer (i.e. layers 312) during the heating period shown in FIG. 9. In the chart, thicknesses of the PM layer along the length of the filter block 160 measured at similar time intervals are plotted in thickness traces 360, 362, and 364, respectively. The traces illustrate the progressive reduction in the thickness of the PM layer during the first combustion process that results from the removal of the surface layer (i.e. surface layer 320).

FIGS. 9-10 illustrate the progression of combustion during the first combustion process and the corresponding reduction in the mass of PM accumulated within the PM filter 136. FIGS. 9-10 further illustrate that combustion of the surface layer 320 may continue for a period after the period during which heat is supplied to the exhaust to initiate and promote combustion (i.e. first heating period). Where a surface layer 320 in two or more projected volumes 178 of the filter block 160 are combusted in series, periods of combustion within the projected volumes 178 may overlap although the corresponding first heating periods do not.

Upon completion of the first combustion process, a second combustion process is commenced. The second combustion process may commence at the end of the first combustion process or within a short period thereafter. During the second combustion process, the remaining PM within the layers 312 is combusted during a second heating period. Generally, the second heating period will be of a longer duration than the first heating period and may be greater than the sum of the first heating periods of the first combustion process. The second heating period may be of a longer duration where the mass of PM remaining after the first combustion process is greater than the mass combusted during the first combustion process. The second heating period may be of a longer duration where the inlet surface 172 is heated to a lower temperature during the second combustion process than during the first combustion process. Additionally, the second heating period will generally be of a longer duration than the cooling period that inhibits continued combustion in the first combustion process.

The second combustion process may be carried out by conventional methods for regeneration. In one conventional method, the temperature of the inlet surface 172 of the filter block 160 is raised to a temperature at which combustion of the remaining PM may be initiated and sustained for the duration of the second heating period. For example only, the inlet surface 172 may be raised to and maintained at a temperature around 600° C. during the second period. More particularly, the inlet surface 172 may be raised to temperatures of 550° C. for a first period, then 600° C. for a second period, and then 630° C. for a third period. The first, second, and third periods may each be around ten minutes, for example. In such a case, the second heating period would be thirty minutes. The second heating period, including the first, second, and third periods, may be predetermined periods that are based on the temperature at which the inlet surface 172 is operated.

The second combustion process may be carried out in an active process whereby fuel is injected into the exhaust and combusted upstream of the PM filter 136 such that the desired temperature of the upstream end is achieved. For example, during the combustion process a secondary mass of fuel may be injected into the exhaust by the fuel injector 138 and combusted in the DOC converter 142, thereby raising the temperature of the exhaust. Other methods of regulating the engine 104, such as retarded primary fuel injection and intake air throttling, may also be used. Additionally, one or more of the heating zones 174 may be actuated to supply additional heat and thereby raise the temperature of the exhaust even further.

Figure 11:
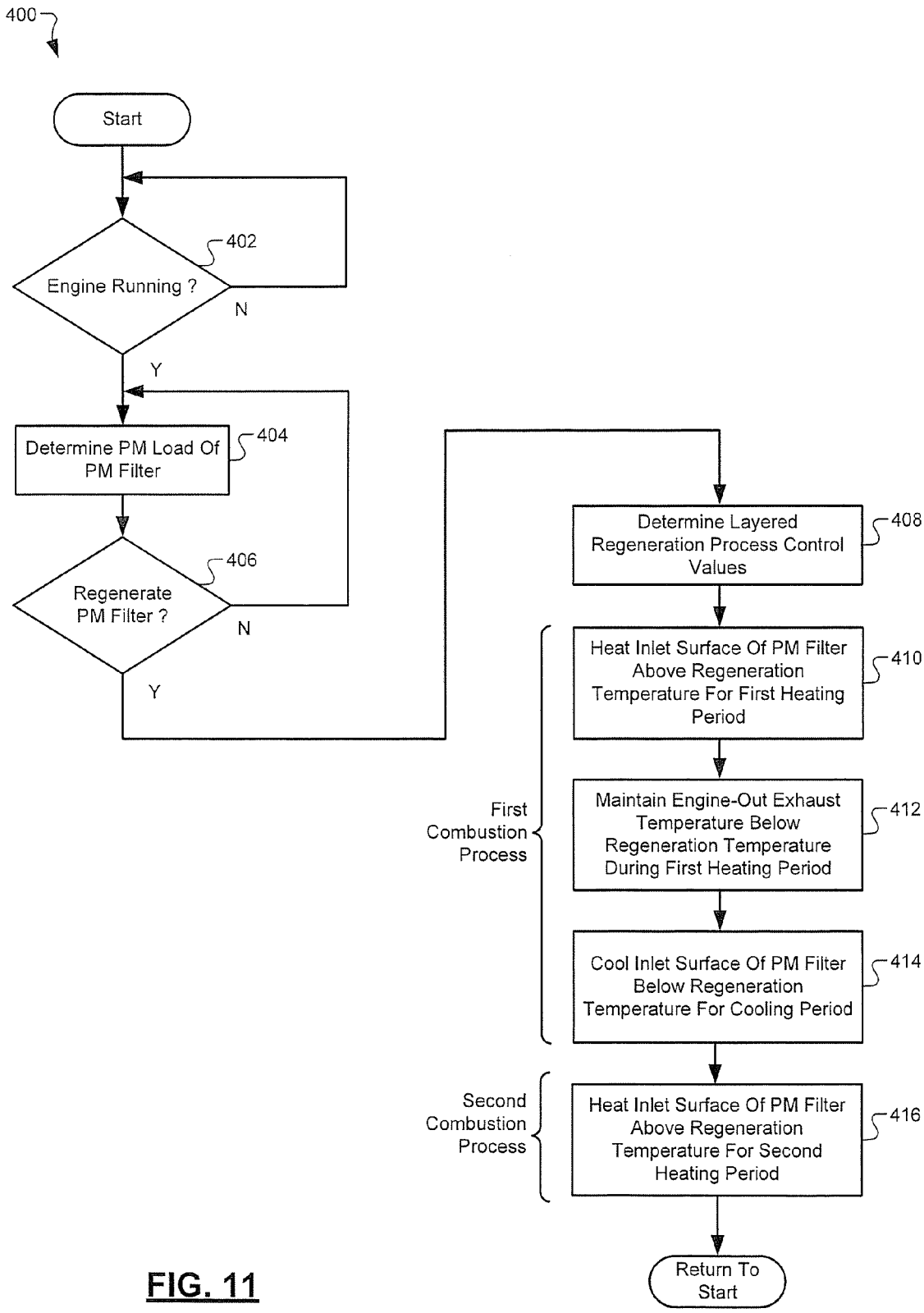
FIG. 11 is a flow chart illustrating exemplary steps in a method for performing regeneration according to the present disclosure.

With particular reference to FIG. 11, an exemplary control method 400 for regenerating a PM filter (e.g. PM filter 136) according to the present disclosure is provided. The method 400 will be described with reference to the engine and exhaust system 100 and control values previously disclosed herein. The method 400 may be implemented in one or more modules, such as the exhaust system module 190. The method 400 may be run periodically during operation of the engine 104 to manage buildup of PM within the PM filter 136.

The method 400 begins in step 402 where control determines whether the engine 104 is running. If the engine 104 is running, then control proceeds in step 404, otherwise control loops back as shown.

In step 404, control determines a PM load of the PM filter 136 and control proceeds in step 406. As previously discussed herein, the PM load may be an estimated mass of PM accumulated within the PM filter 136. Control proceeds in step 406 where control determines whether to regenerate the PM filter 136. Control may determine whether to regenerate by comparing the PM load and a threshold load. The threshold load may represent a threshold mass. Accordingly, control may determine to regenerate the PM filter 136 when the PM load is greater than the threshold load. If control determines to regenerate the PM filter 136, then control proceeds in step 408, otherwise control loops back as shown.

In step 408, control determines the control values for operating the engine and exhaust system 100 during the layered regeneration process performed in subsequent steps. The control values may include, but are not limited to the first and second target inlet temperatures and ranges for the inlet surface 172, target engine-out exhaust temperatures and ranges, the target zone inlet exhaust temperatures, the zone sequence, and the heating and actuation periods for the electric heater 162 previously discussed herein.

Next, in steps 410-414, control regulates operation of the engine and exhaust system 100 such that a portion of the PM accumulated in the layers 312 is combusted in a first combustion process. In particular, control regulates operation such that combustion is limited to the surface layer 320 of accumulated PM. In step 410, control heats the inlet surface 172 to within a first inlet temperature range above the regeneration temperature for a first heating period. Control may actuate the electric heater 162 during the first heating period to heat the exhaust entering the PM filter 136 and thereby heat the inlet surface 172 to a first target inlet temperature. Control may actuate the electric heater 162 such that the exhaust enters the PM filter 136 at a target zone inlet exhaust temperature.

Control may simultaneously actuate the resistive coils 170 of each of the heating zones 174 and thereby concurrently combust the surface layer 320 in each projected volume 178. Alternatively, control may sequentially actuate each of the resistive coils 170 for corresponding actuation periods and according to the zone sequence. In this manner, control may sequentially combust the surface layer 320 in each projected volume 178. In both of the foregoing approaches, control may selectively actuate the resistive coils 170 and thereby initiate combustion and combust the surface layer 320 of selected projected volumes 178.

As shown in step 412, control may maintain the temperature of the exhaust exiting the engine 104 within a first exhaust temperature range below the regeneration temperature during the first heating period. In particular, control may maintain the temperature of the exhaust at a target engine-out exhaust temperature. Control may regulate exhaust temperature in the foregoing manner in order to facilitate cooling of the inlet surface 172 in the subsequent step.

Next, in step 414, control cools the inlet surface 172 below the regeneration temperature for a cooling period following the first heating period. Control cools the inlet surface 172 below the regeneration temperature in order to inhibit continued combustion of the surface layer 320. In this manner, control may halt combustion of the surface layer 320 and control the portion of the layers 312 combusted during the first combustion process. Control may maintain the temperature of the exhaust exiting the engine 104 within the first exhaust temperature range during the cooling period. The cooling period may be less than the first heating period.

Control proceeds in step 416 where control regulates operation of the engine and exhaust system 100 for a second heating period such that the remaining PM accumulated in the layers 312 is combusted in a second combustion process. Control may regulate operation such that the temperature of the inlet surface 172 is maintained within a second inlet temperature range above the regeneration temperature for the second heating period. Control may maintain the inlet surface 172 at a second target inlet temperature. In this manner, control may initiate and combust the remaining PM in the layers 312. The second heating period may be greater than the first heating period and the cooling period. Control under the method 400 ends in step 414 at the end of the second heating period.

Figure 12:
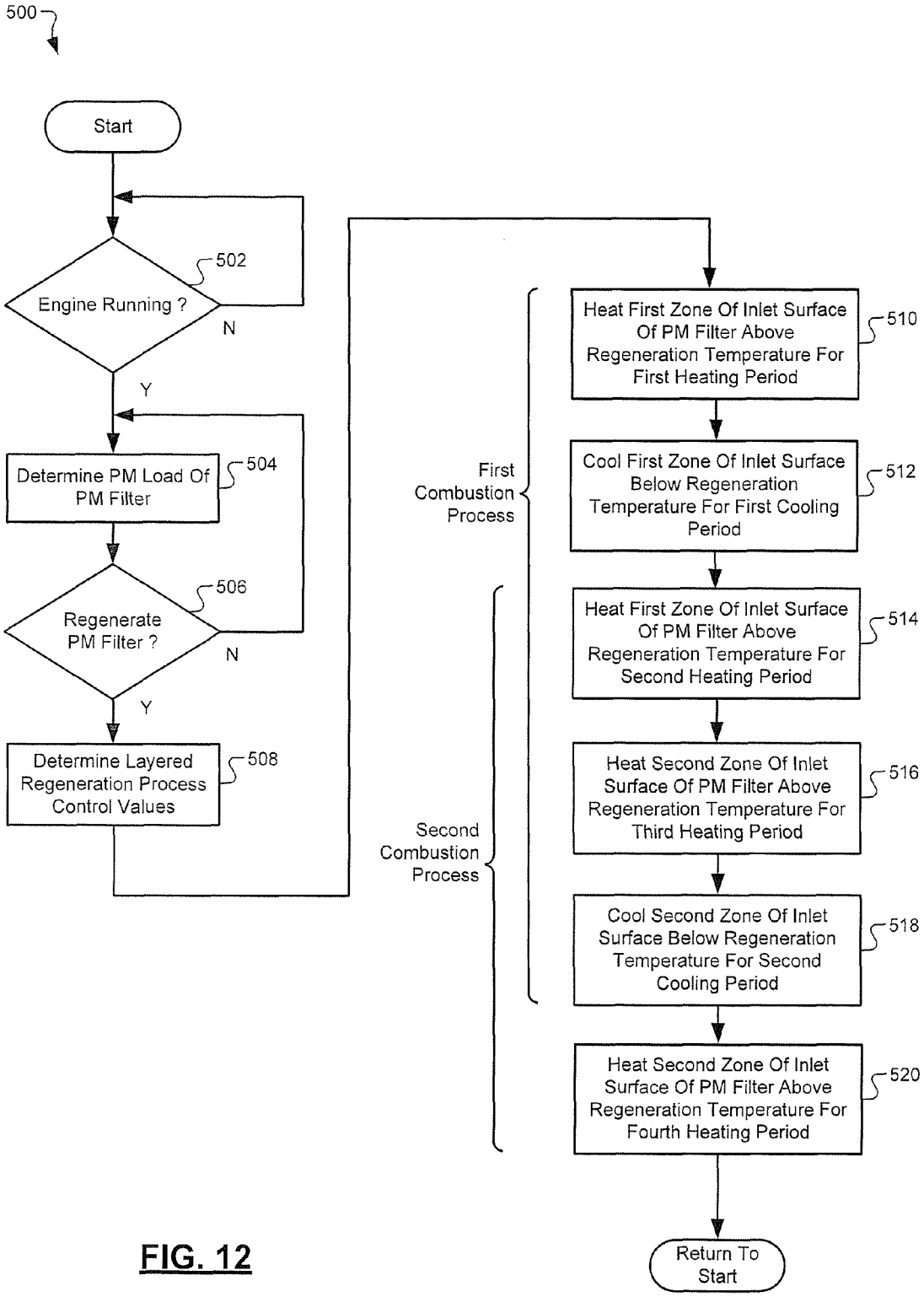
FIG. 12 is a flow chart illustrating exemplary steps in another method for performing regeneration according to the present disclosure.

With particular reference to FIG. 12, another exemplary control method 500 for regenerating a PM filter (e.g. PM filter 136) according to the present disclosure is provided. The method 500 is similar to the method 400, except that in the method 500, the heating periods during which a portion of the PM accumulated in two projected volumes 178 is combusted in a first combustion process overlaps with the heating periods during which the remaining PM in the two projected volumes 178 is combusted in a second combustion process. While the method 500 discloses a layered regeneration process involving two projected volumes 178, it will be appreciated that additional projected volumes 178 may be included in the method 500.

The method 500 begins in step 502 where control determines whether the engine 104 is running. If the engine 104 is running, then control proceeds in step 504, otherwise control loops back as shown.

In step 504, control determines a PM load and control proceeds in step 506. In step 506, control determines whether to regenerate the PM filter 136. Control may determine whether to regenerate by comparing the PM load and a threshold load. If control determines to regenerate the PM filter 136, then control proceeds in step 508, otherwise control loops back as shown.

In step 508, control determines the control values for operating the engine and exhaust system 100 in subsequent steps. The control values may include, but are not limited to the first and second target inlet temperatures and ranges for the inlet surface 172, target engine-out exhaust temperatures and ranges, the target zone inlet exhaust temperatures, the zone sequence, and the heating and actuation periods for the electric heater 162 previously discussed herein.

In step 510, control heats a first zone of the inlet surface 172 to within a first inlet temperature range above the regeneration temperature for a first heating period. Control may actuate a resistive coil 170 of a corresponding first heating zone 174 during the first heating period to heat the first zone. In this manner, control may cause combustion of a portion of the layers 312 (e.g., the surface layer 320) of PM in the projected volume 178 corresponding to the first heating zone 174. Control may maintain the temperature of the exhaust exiting the engine 104 below the regeneration temperature during the first heating period.

Next in step 512, control cools the first zone below the regeneration temperature for a first cooling period following the first heating period and thereby inhibits continued combustion of the PM in the corresponding projected volume 178. During the cooling period, control may de-actuate the corresponding resistive coil 170 and may maintain the temperature of the exhaust within a first exhaust temperature range below the regeneration temperature. The first cooling period may be less than the first heating period.

Next in step 514, control heats the first zone within a second inlet temperature range above the regeneration temperature for a second heating period. In this manner, control may cause combustion of the remaining PM in the layers 312 in the corresponding projected volume 178. Control may actuate the corresponding resistive coil 170 to heat the first zone. The second heating period may be greater than the first heating period and the first cooling period.

Next in step 516, control heats a second zone of the inlet surface 172 to within the first inlet temperature range during a third heating period. In this manner control may cause combustion of a portion of the layers 312 of PM in the projected volume 178 corresponding to the second heating zone 174. Control may actuate a resistive coil 170 of a corresponding second heating zone 174 to heat the second zone. Control may maintain the temperature of the exhaust exiting the engine 104 below the regeneration temperature during the third heating period.

Next in step 518, control cools the second zone below the regeneration temperature for a second cooling period following the third heating period and thereby inhibits continued combustion of the PM in the corresponding projected volume 178. During the second cooling period, control may de-actuate the corresponding resistive coil 170 and may maintain the temperature of the exhaust within the first exhaust temperate range. The second cooling period may be less than the third heating period.

Next in step 520, control heats the second zone to within the second inlet temperature range for a fourth heating period. In this manner, control may cause combustion of the remaining PM in the layers 312 in the projected volume 178 corresponding to the second heating zone 174. Control may actuate the corresponding resistive coil 170 to heat the second zone. The fourth heating period may be greater than the third heating period and the second cooling period. Control under the method 500 ends in step 508 at the end of the second period.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A control system for an engine comprising:

a first electronic circuit configured to generate a request to regenerate a particulate matter (PM) filter that filters PM from exhaust of said engine based on one or more operating parameter; and a second electronic circuit configured to response to said request, regulates operation of said engine and an electric heater maintains said inlet surface of said PM filter such that:

for a first heating period, said electric heater maintains said inlet surface within a first inlet temperature range above a regeneration temperature of said PM filter and combustion of a first mass of accumulated PM within said PM filter is initiated, for a cooling period following said first heating period, said exhaust cools said inlet surface to within a second inlet temperature range below said regeneration temperature and combustion of said first mass is inhibited, and for a second heating period following said cooling period, said inlet surface is maintained within a third inlet temperature range above said regeneration temperature and a second mass of said accumulated PM is combusted, wherein said cooling period is less than said first heating period and said second heating period, wherein said first heating period is less than said second heating period, and wherein said second heating period immediately follows said cooling period.

2. The control system of claim 1 wherein said first heating period is based on one of a first exhaust temperature of said exhaust and a concentration of oxygen in said exhaust.

3. The control system of claim 1 wherein during said first heating period said electric heater maintains said inlet surface at a target inlet temperature that is based on one of a first exhaust temperature of said exhaust and a concentration of oxygen in said exhaust.

4. The control system of claim 1 wherein first temperatures that bound said first inlet temperature range are greater than second temperatures that bound said third inlet temperature range.

5. A control system for an engine comprising:

a first electronic circuit configured to generate a request to regenerate a particulate matter (PM) filter that filters PM from exhaust of said engine based on one or more operating parameter; and a second electronic circuit configured to response to said request, regulates operation of said engine and an electric heater maintains said inlet surface of said PM filter such that:

for a first heating period, a first resistive coil of said electric heater maintains a first zone of said inlet surface within a first inlet temperature range above a regeneration temperature of said PM filter and combustion of a first mass of accumulated PM within said PM filter is initiated, said first mass corresponding to said first zone for a second heating period following said first heating period, a second resistive coil of said electric heater maintains a second zone of said inlet surface within said first inlet temperature range and combustion and combustion of a second mass of accumulated PM within said PM filter is initiated, said second mass corresponding to said second zone, for a first cooling period following said first heating period, exhaust of said engine cools said first zone to within a second inlet temperature range below said regeneration temperature and combustion of said first mass is inhibited, for a second cooling period following said second heating period exhaust of said engine cools said second zone to within said second inlet temperature range and combustion of said second mass is inhibited, and for a third heating period following said first and second heating periods and said first and second cooling periods, said first and second zones of said inlet surface are maintained within a third inlet temperature range above said regeneration temperature and a third mass of said accumulated PM is combusted, said third mass corresponding to said first and second zones.

6. The control system of claim 5 wherein said second heating period follows said first cooling period.

7. The control system of claim 6 wherein said first and second cooling periods are less than said first, second, and third heating periods, and wherein said third heating period immediately follows said second cooling period.

8. The control system of claim 5 wherein first temperatures that bound said first inlet temperature range are greater than second temperatures that bound said third inlet temperature range.

9. A method for controlling an engine comprising:

receiving a request to regenerate a particulate matter (PM) filter that filters PM from exhaust of said engine; and regulating, in response to said request, operation of said engine and an electric heater that heats an inlet surface of said PM filter such that:

for a first heating period, said electric heater maintains said inlet surface within a first inlet temperature range above a regeneration temperature of said PM filter and combustion of a first mass of accumulated PM within said PM filter is initiated;

for a cooling period following said first heating period, said exhaust cools said inlet surface to within a second inlet temperature range below said regeneration temperature and combustion of said first mass is inhibited; and for a second heating period following said cooling period, said inlet surface is maintained within a third inlet temperature range above said regeneration temperature and a second mass of said accumulated PM is combusted, wherein said cooling period is less than said first heating period and said second heating period, wherein said first heating period is less than said second heating period, and wherein said second heating period immediately follows said cooling period.

10. The method of claim 9 wherein said first heating period is based on one of a first exhaust temperature of said exhaust and a concentration of oxygen in said exhaust.

11. The method of claim 9 wherein during said first heating period, said electric heater maintains said inlet surface at a target inlet temperature that is based on one of a first exhaust temperature of said exhaust and a concentration of oxygen in said exhaust.

12. The method of claim 9 wherein first temperatures that bound said first inlet temperature range are greater than second temperatures that bound said third inlet temperature range.

13. The method of claim 9 wherein said first inlet temperature range includes temperatures between 700° C. and 800° C.

14. The method of claim 9 wherein an exhaust temperature of said exhaust during said cooling period is less than 450° C.

15. A method for controlling an exhaust system of an engine, the method comprising:

determining whether a particulate matter (PM) filter in the exhaust system requires regeneration, the PM filter being associated with an electric heater located upstream from the PM filter;

controlling at least one of the electric heater and the engine to increase a temperature of exhaust gas produced by the engine to greater than a first temperature for a first period, the first temperature indicating a temperature for causing the PM filter to regenerate;

controlling at least one of the electric heater and the engine to decrease the temperature of the exhaust gas produced by the engine to less than the first temperature for a second period; and controlling at least one of the electric heater and the engine to increase the temperature of the exhaust gas produced by the engine to greater than the first temperature for a third period, wherein the first period indicates a period to regenerate a portion of PM in the PM filter, the portion being less than a total amount of PM in the PM filter, and wherein the second period indicates a period to regenerate a remainder of the total amount of PM in the PM filter.

16. The method of claim 15, wherein the second period immediately follows the first period.

17. The method of claim 15, wherein the third period immediately follows the second period.

18. The method of claim 15, further comprising increasing the temperature of the exhaust gas produced by the engine to a second temperature during the first period, the second temperature being greater than the first temperature, and increasing the temperature of the exhaust gas produced by the engine to a third temperature during the third period, the third temperature being greater than the second temperature.

19. The method of claim 18, further comprising controlling only one of the electric heater and the engine to increase the temperature of the exhaust gas produced by the engine to the third temperature during the third period.

20. The method of claim 15, further comprising increasing the temperature of the exhaust gas produced by the engine to a second temperature during the first period, the second temperature being greater than the first temperature, and increasing the temperature of the exhaust gas produced by the engine to a third temperature during the third period, the third temperature being less than the second temperature and greater than the first temperature.

21. The method of claim 20, wherein the second temperature is within a range from 700 to 800 degrees Celsius, and wherein the third temperature is within a range from 550 to 650 degrees Celsius.

* * * * *